US007114186B2

(12) United States Patent
Steeghs et al.

(10) Patent No.: US 7,114,186 B2
(45) Date of Patent: Oct. 3, 2006

(54) BALLISTIC VEST

(75) Inventors: Peter H. W. Steeghs, Heerlen (NL); Marc Blaauw, Maastricht (NL); Wilhelmus A. R. M. Pessers, Liempde (NL); Jan L. Lindemulder, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 11/007,330

(22) Filed: Dec. 9, 2004

(65) Prior Publication Data

US 2005/0097647 A1 May 12, 2005

Related U.S. Application Data

(63) Continuation of application No. 10/215,262, filed on Aug. 9, 2002, now abandoned, which is a continuation of application No. PCT/NL01/00091, filed on Feb. 5, 2001.

(30) Foreign Application Priority Data

Feb. 10, 2000 (NL) ..... 1014345

(51) Int. Cl.
*F41H 1/02* (2006.01)

(52) U.S. Cl. ..... 2/2.5

(58) Field of Classification Search ..... 2/2.5
See application file for complete search history.

(56) References Cited

U.S. PATENT DOCUMENTS

| | | | | |
|---|---|---|---|---|
| 3,974,313 A | | 8/1976 | James | |
| 5,440,965 A | * | 8/1995 | Cordova et al. | 89/36.02 |
| 5,926,842 A | * | 7/1999 | Price et al. | 2/2.5 |
| 6,003,424 A | | 12/1999 | Cordova et al. | |
| 6,266,819 B1 | | 7/2001 | Bachner, Jr. | |
| 6,475,936 B1 | * | 11/2002 | Chiou | 442/203 |

FOREIGN PATENT DOCUMENTS

| | | |
|---|---|---|
| EP | 265550 | 5/1988 |
| GB | 883529 | 11/1961 |
| WO | WO 93/04336 | 3/1993 |
| WO | WO 97/21976 | 6/1997 |

* cited by examiner

*Primary Examiner*—John J. Calvert
*Assistant Examiner*—Andrew W. Sutton
(74) *Attorney, Agent, or Firm*—Mayer, Brown, Rowe & Maw LLP

(57) ABSTRACT

The invention relates to a ballistic vest containing a stock of flexible fabrics and a stack of flexible unidirectional layers, in which the fabrics contain strong fibres of a first kind, the unidirectional layers contain strong fibres of a second kind, and in which the fibres in a unidirectional layer run essentially parallel and are disposed at an angle to fibres in an adjacent layer which is greater than 0 degrees, where in that the flexible fabric is a loose fabric and is located on the strike side of the vest.

The percentages by weight of the loose fabrics and the stack of UD layers preferably is between 15:85 and 30:70%. In that case, a vest of areal density less than 6 kg/m$^2$ can have such ballistic resistance as to stop an Action 3 bullet with a velocity of up to 437 m/s with a trauma to NIJ Standard of less than 44 mm.

22 Claims, No Drawings

BALLISTIC VEST

CROSS REFERENCE TO RELATED APPLICATION

This application is a continuation of U.S. Ser. No. 10/215,262, filed Aug. 9, 2002, now abandoned which is a continuation of International Application No. PCT/NL01/00091, filed Feb. 5, 2001, which designates the United States. These applications, in their entirety, are incorporated herein by reference.

The invention relates to a ballistic vest containing a stack of flexible fabrics and a stack of flexible unidirectional layers, in which the fabrics contain strong fibres of a first kind, the unidirectional layers contain strong fibres of a second kind, and in which the fibres in a unidirectional layer run essentially parallel and are disposed at an angle to fibres in an adjacent layer which is greater than 0 degrees. The invention more particularly relates to vests that provide protection against hollow-point bullets.

Changing threats in the form of new types of bullet require protective garment designs to be adapted time and again. It has appeared, for example, that none of current vest designs offers protection against a new type of bullets (Action 3 bullets), which because of their hollow point tend to remain lodged in the body. Protection against this type of bullet requires a vest weight so high as to cause discomfort.

Vests that protect against different threats are known in the art U.S. Pat. No. 5,926,842, for example, discloses a ballistic vest consisting of a stack of flexible plain weave fabric layers and a stack of flexible unidirectional layers, herein referred to as UD layers, in which the fibres run essentially parallel and are disposed at an angle of 90 degrees to the fibres in an adjacent layer. Such a stack of at least two cross-plied UD layers is herein referred to as a UD cross-ply. U.S. Pat. No. 5,926,842 teaches that the UD cross-plies are preferably located on a strike side of the vest. A vest of this kind with an areal density of approx 4.9 kg/m$^2$ offers, for example, protection against threats such as those specified in the NIJ2 and NIJ2a standards.

In seeking protection against Action 3 bullets, various designs from U.S. Pat. No. 5,926,842 were tested. These tests indicated that fabric, whether or not in combination with high tensile strength polyethylene fibres in a UD cross-ply assembly for a vest according to the assemblies in U.S. Pat. No. 5,926,842, only offers protection against Action 3 bullets with a velocity of 430 m/s if the areal density of the vest is at least 6.5 kg/m$^2$. Such high areal density substantially reduces the vest's wearing comfort.

The object of the invention is to provide a vest with a lower areal density that offers protection against Action 3 bullets.

This object is achieved according to the invention by the flexible fabric being a loose fabric and being located on the strike side of the vest. This ensures that a vest of the invention with areal density of less than 6 k/m$^2$ offers protection against Action 3 bullets.

A loose fabric here and hereinafter means a fabric the yarns in which ran readily move relative to one another. Such a fabric is also deformable. Surprisingly, it has been found that a vest provided with a loose fabric on the strike side of the vest offers improved protection against Action 3 bullets. Also, the vest of the invention, with lower areal density, can offer the same protection as a vest that does not contain a loose fabric on the strike side.

An advantage of the vest of the invention is that it is more comfortable to wear because of its lower weight.

The ballistic resistance of a vest can be classified according to various standards. One such standard is NIJ Standard 0101.03, which defines various levels of protection. A vest to the NIJ2a standard must stop for example a 0.357 Magnum JSP with a velocity of 381 m/s and also a 9 mm FMJ with a velocity of 332 m/s.

A vest to the NIJ3a standard must stop a 0.44 Magnum SWC at 426 m/s and a 9 mm FMJ at 426 m/s. In addition to preventing projectile penetration, the extent to which the body side deforms behind an impact is a second requirement of NIJ Standard 0101.03. This deformation measures the trauma experienced by the wearer of a vest on impact of a projectile. An advantage of the vest of the invention is that, despite its lower weight, deformation on the body side of the vest meets the requirement of NIJ Standard 0101.03.

Loose fabrics may be for example twill weave, honeycomb weave, cord weave or three-dimensional fabrics. It is essential here that the fabric be a drapable one. A drapable fabric generally is a fabric in which the number of floats is at least 3, which means that the fabric contains yarns that at the same time cross at least 3 other yarns.

Preferably, the fibres in the loose fabrics are also substantially stretched. Non-wovens were found not to contribute to stopping Action 3 bullets.

It is preferred for the loose fabric to be a twill weave fabric. I will weave fabrics are fabrics in which the warp and weft do not cross one another at a 1:1 ratio, as they do in a fabric with plain weave, but at a ratio other than 1:1. In for example a 4.1 twill weave fabric, the weft crosses 4 warp yarns on one side of the fabric, 1 warp yarn on the other side of the fabric and so forth. The number of floats in such a fabric is 1. It is preferred for the fabric of the invention to be a 5.1 twill weave. This provided the highest protection against Action 3 bullets at the lowest vest weight.

The stack of UD layers may consist of one UD package or a plurality of UD packages. The stack of UD layers preferably consists of a plurality of UD packages each of which contains two or four UD layers. Preferably, the packages are provided with a smooth film on both sides, resulting in reduced friction between the packages and higher flexibility of the stack.

"Fibers" should here be understood to mean elongated bodies whose length is substantially larger than the width and thickness. Fibres comprise continuous monofilaments and multifilaments as well as discontinuous filaments such as staple fibres or cut fibres.

In general, the percentages by weight of the stack of loose fabrics and the stack of UD layers in the vest may be between 10.80 and 50.50%. If the percentage by weight of loose fibres is less than 10%, a disproportionately high number of UD layers need to be added to the vest causing the advantage of lower weight to be lost. If the percentage by weight of loose fibres is greater than 50%, any additional layers of twill fabric contribute less than proportionately to protection against Action 3 bullets, again causing the advantage of lower weight to be lost.

It is preferred for the percentages by weight of the stack of loose fabrics and the stack of UD layers to be between 15:85 and 30:70%.

This ensures that a vest of the invention with a first and second stack, which together have an areal density of less than 6 kg/m$^2$, has such ballistic resistance as to stop an Action 3 bullet with a velocity of up to 437 m/s with a trauma to NIJ Standard of less than 44 mm.

This also ensures that a vest of the invention, in which the first and second stack have a total areal density of less than 5.2 kg/m$^2$, has a ballistic resistance such that the vest complies with the NIJ3a standard.

This also ensures that a vest of the invention with a first and second stack, which together have an areal density of less than 4.5 kg/m$^2$, has such ballistic resistance as to stop an Action 3 bullet with a velocity of up to 385 m/s with a trauma to NIJ Standard of less than 44 mm.

"Strong fibres" of a first or second kind may be of different kinds or of the same kind and in the present invention generally are fibres with a strength of at least 6 dN/tex, a modulus of at least 130 dN/tex and a fracture energy of at least 8 J/g. Strong fibres preferably are fibres with a strength of a least 10 dN/tex, a modulus of at least 200 dN/tex and a fracture energy of at least 20 J/g. Strong fibres more preferably are fibres with a strength of at least 16 dN/tex, a modulus of at least 400 dN/tex and a fracture energy of at least 27 J/g. Strong fibres most preferably are fibres with a strength of at least 28 dN/tex, a modulus of at least 1200 dN/tex and a fracture energy of at least 40 J/g. If the fibres of the first kind do not have the same strength as the fibres of the second kind, it is recommended that the fibres of the first kind be stronger than the fibres of the second kind.

Suitable strong fibres are fibres of aramid, polybenzazole (PBO), silicium carbide and/or a reinforced polymer such as drawn ultra-high molecular weight polyethylene (HPPF) and/or combinations thereof Ultra-high molecular weight polyethylene means polyethylene with a weight-average molecular weight of at least 500,000 kg/kmol.

It is preferred for the molecular weight to be greater than 2,000,000 kg/kmol. It is preferred for the vest of the invention to have a stack of UD layers in which the UD layers mainly contain aramid or PBO fibres. This ensures that a vest in which the first and second stack have a combined areal density of less than 4 kg/m$^2$ has such ballistic resistance as to stop an Action 3 bullet with a velocity of up to 385 m/s with a trauma to NIJ standard of less than 44 mm.

An advantage of the vest of the invention is that a construction in which unidirectional layers are replaced with loose fabrics offers improved protection against certain types of ammunition including Action 3 bullets. Given that loose fabrics are much simpler to produce, the production costs of a vest of the invention are lower than those of known vests consisting solely of UD layers.

Ballistic fabrics such as those applied in known vests are predominantly tightly woven fixed fabrics, often with a yarn having as low a titre as possible. Both the manufacture of yarns and the manufacture of fabrics therefrom is much more costly than the manufacture of UD cross-ply.

The titre of the yarns for the loose fabric need not meet any particular requirements. It is preferred, however, for the vest of the invention to contain a fabric package in which the fabric essentially consists of yarns with a titre of at least 1000 dTex. With such yarns better results are achieved than with fabric packages from yarns with a titre of less than 1000 dTex. An additional advantage of yarns with a higher titre is that both the yarns and the fabric formed therefrom can be produced more cheaply than yarns with a lower titre.

The invention is elucidated with reference to some examples.

Areal density (AD) of a fabric or UD layer or package means the weight of a fabric or UD layer per unit area.

UD-SB2 is a package of four cross plied layers in which the fibres in each layer run substantially in parallel and are disposed perpendicularly to the fibres in an adjacent layer, with each layer being fabricated of HPPE yarns (Dyneema®). The yarn weight per layer is 26 g/m$^2$. The UD-SB2 package contains a rubber matrix and is covered on both sides with a PE film. An UD-SB2 package has an AD of 155 g/m$^2$.

UD-SB21 is a package of four cross-plied layers in which the fibres in each layer run substantially in parallel and are disposed perpendicularly to the fibres in an adjacent layer, with each layer being fabricated of HPPE yarns (Dyneema®). The yarn weight per layer is 26 g/m$^2$. The UD-SB21 package contains a rubber matrix and is covered on both sides with a PE film. An UD-SB21 package has an AD of 145 g/m$^2$.

Goldflex is a 4-layer cross-ply UD based on 1100 dTex aramid yarns with an AD of 233 g/m$^2$.

W557 is a 5.1 twill weave fabric with the warp and weft consisting of a 1760 dTex HPPE yarn (Dyneema®). The areal density of a fabric layer is 270 g/m$^2$. The fabric is loose and well drapable.

Aramid fabric is a non-deformable plain weave fabric based on 930 dTex aramid yarn (Twaron® TC) with an AD of 200 g/m$^2$.

Twaron VD0461 is a fixed, non deformable fabric based on 3360 dTex aramid yarn with an areal density of 475 g/m$^2$.

Fraglight® is a nonwoven based on HPPE staple fibre of more than 880 dTex with an AD of 205 g/m$^2$.

In all examples and comparative experiments, the fabric was positioned on the strike side of a fabric-cum-UD vest unless expressly otherwise stated.

EXAMPLE I

Vests of a stack of 29 packages of UD-SB2 and 5 layers of W557 with total areal density of 5.85 kg/m$^2$ were fired at with Action 3 (A3) bullets at 440, 432, 433, 430 and 437 m/s.

None of the bullets fully penetrated. This observation is highly surprising given that the fabric concerned was a fairly coarse fabric made of 1/60 dTex Dyneema® yarn. The development in the art of every better ballistic fabrics until now went in the direction of the use of increasingly finer fabrics with, in addition, an increasingly lower areal density per layer. This direction is opposite of the one of the present invention using loose fabrics.

EXAMPLE II

A vest of a stack of 20 packages of UD-SB2 and 4 layers of W557 was fired at with A3 bullets at 385 m/s. The vest, with AD of 4.2 kg/m$^2$, showed no full penetration. In comparison with the vest referred to in Example I, which stops A3 bullets at 430 m/s, this vest is lighter for 385 m/s than might be expected in light of the energy absorption in the vest with AD of 5.85 kg/m$^2$.

EXAMPLE III

A vest of a stack of 12 packages of aramid cross-ply-UD (Goldflex) and 4 layers of W557 was fired at with A3 bullets at 385 m/s. The vest, with AD of 3.9 kg/m$^2$, showed no full penetration.

EXAMPLE IV

A vest of a stack of 20 packages of US-SB2 and 4 layers of a 3 1 twill weave fabric of 1/60 dTex yarns (AD per layer of 275 g/m$^2$, AD of the vest is 4.4 kg/m$^2$) was fired at at 362, 376, 416, 422, 430 and 431 m/s.

Full penetration was found to have occurred at 378 and 430 m/s. Stops were found at 362, 416, 422 and even at 431 m/s. Because of the inconsistency (full penetration at 378 and a stop a 431 m/s) a 2$^{nd}$ vest of the same composition was tested, result: 1 full penetration at 431 m/s, for the rest only stops, that is, at 407, 415, 426, 431, 433, 425 and 436 m/s. Thus, this fabric in combination with SB2 makes it possible to stop A3 bullets but seems less consistent because of full penetration at 378 m/s.

EXAMPLE V

Firing tests were conducted in accordance with the NIJ2 standard, with a vest of a stack of 20 packages of UD-SB2 and 4 layers of W557 being tested with the 9 mm 360 m/s and the 0.357 Magnum at 425 m/s. No full penetration was observed in either case. Thus, a vest of a stack of 20 packages of UD-SB2 and 4 layers of W557 with AD of 4.2 kg/m$^2$ meets the NIJ standard. The current recommendation for an SB-2 vest that meets the NIJ 2 standard is a stack of 20 packages of UD-SB2 with AD of 4.5 kg/m$^2$.

EXAMPLE VI

Firing tests were conducted in accordance with the NIJ3a standard a. with 9 mm: A vest of a stack of 20 packages of UD-SB2 and 4 layers of W557 was fired at with 9 mm at 425 m/s. Next, V50 was determined. Three stops were found at 425 m/s and the V50 was 491 m/s.
b. with 0.44 Magnum: A vest of a stack of 26 packages of UD-SB2 and 4 layers of W557 was fired at with 0.44 Magnum at 425 m/s and next V50 was determined. Three stops were found at 425 m/s with a trauma smaller than 44 m and V50 was 476 m/s.

Conclusion: A vest of a stack of 26 packages of UD-SB2 and 4 layers of W657 with AD of 5.1 kg/m$^2$ complies with the NIJ3a standard for 9 mm and 0.44 Magnum. The current SB2 recommendation for meeting this standard is a vest of a stack of UD-SB2 packages of 5.3 kg/m$^2$.

EXAMPLE VII

Testing of protection against Ranger SXT+P+ ammunition. Similarly to Action 3 bullets, this is a Jacketed Hollow Point bullet.

A vest of a stack of 20 packages of UD-SB2 and 4 layers of W557 (AD of 4.2 kg/m2) was tested with Ranger SXT 9 mm bullets at 425 m/s.

Stops were found at 421 and 425 m/s with traumas of 33 and 35 mm, respectively.

Since the vest tested here was identical to the vest in Example V and the vest in Example VI contained 6 extra UD-SB2 packages, this means that the vests for NIJ2 and NIJ3a in Examples V and VI also stop Ranger SXT+P+ bullets.

EXAMPLE IIX

A vest of a stack of 20 packages of UD-SB2 and 4 layers of a loose, readily deformable plain weave fabric (368 g/m$^2$), in which both the warp and weft incorporated 5 parallel HPPE 1760 dTex yarns (5 floats), was fired at with A3 bullets at 410 m/s. No full penetration was found to have occurred in the vest, with AD of 4.6 kg/m$^2$.

EXAMPLE IX

A vest of a stack of 20 packages of UD-SB2 and 3 layers of a loose, readily deformable cord weave fabric (287 g/m$^2$) with 3 and more floats, made of 1760 dTex HPPE was fired at with A3 bullets at 410 m/s. The vest, with AD of 4.3 kg/m$^2$, did not reveal full penetration.

EXAMPLE X

Vests of a stack of 20 packages of UD-SB21 and 4 layers of W557 with total areal density of 4 kg/m2 were fired at with FSP fragments in order to determine V50. V50 was found to be 549 m/s.

EXAMPLE XI

Vests of a stack of 20 packages of UD-SB21 and 4 layers of W557 with total areal density of 4 kg/m2 were fired at with 9 mm copper jacket bullets. Stops were found at 383 m/s. The trauma depth was 25–35 mm.

EXAMPLE XII

Vests of a stack of 18 packages of UD-SB21 and 4 layers of W557 with total areal density of 3.7 kg/m2 were fired at with FSP fragments in order to determine V50.

V50 was found to be 523 m/s. This shows that the vest of the invention has an unexpectedly high V50 against FSP fragments at this low areal density. Consequently, the energy absorption per unit of areal density is extraordinarily high.

EXAMPLE XIII

Vests of a stack of 18 packages of UD-SB21 and 4 layers of W557 with total areal density of 3.7 kg/m$^2$ were filed at with standard 9 mm bullets. Stops were found at 382 m/s. The trauma depth was 29–38 mm.

EXAMPLE XIV

Vests of a stack of 18 packages of UD-SB21 and 4 layers of W557 with total areal density of 3.7 kg/m$^3$ were fired at with 9 mm cu jacket bullets. Stops were found at 382 m/s. The trauma depth was 24–33 mm.

EXAMPLE XV

Vests of a stack of 18 packages of UD-SB21 and 4 layers of W557 with total areal density of 3.7 kg/m2 were fired at with 9 mm SXT ranger bullets. Stops were found at 375 m/s. The trauma depth was 26–31 mm.

COMPARATIVE EXPERIMENT A

Firing tests were conducted with A3 bullets and packages of different compositions.

The results were as follows:

a) A vest of 12 layers of aramid fabric and a stack of 29 packages of UD-SB2 with AD of 6.9 kg/m$^2$ exhibited penetration at 411 m/s.

b) A vest of 20 layers of aramid fabric and a stack of 14 packages of SB2 with AD of 6.2 kg/m$^2$ exhibited penetration at 442 m/s.

c) A vest of 24 layers of aramid fabric and a stack of 9 packages of UD SB2 with AD of 6.2 kg/m$^2$ exhibited penetration at 436 m/s.

d) A vest of 28 layers of aramid fabric and a stack of 4 layers of SB2 with AD of 6.2 kg/m$^2$ exhibited penetration at 436 m/s.

e) A vest of 31 layers of aramid fabric with AD of 6.2 kg/m$^2$ exhibited penetrations at about 430 m/s.

f) A vest of 18 layers of aramid fabric behind a stack of 20 packages of UD-SB2 with AD of 6.9 kg/m$^2$ exhibited a full penetration at 417 m/s.

g) A vest of 10 layers of fraglight in front of a stack of 20 packages of UD-SB2 with AD of 6.5 kg/m$^3$ exhibited a full penetration at about 421 m/s.

h) It took a vest of 21 packages of W557 with AD of 5.7 kg/m$^2$ to stop A3 at 385 m/s.

i) A vest of 51 packages of UD-SB2 with AD of 7.9 kg/$^2$ proved inadequate to step A3 bullets with a velocity of 400 m/s.

j) The number of layers of aramid fabric needed to stop an A3 bullet with a velocity of 430 m/s was determined. It appeared that this takes stack of 31 layers with AD of 6.5 kg/m$^2$.

COMPARATIVE EXPERIMENT B

Starting from 20 packages of UD SB2, it was determined how many layers of a non-deformable plain weave aramid (Twaron VD 0461) fabric of yarns with a titre of 3360 dTex, positioned in front of the stack of UD-SB2 packages, are needed to stop A3 bullets. It was found that 20 packages of UD-SB2 and 8 layers of aramid fabric with AD of 6.8 kg/m$^2$ are needed to stop A3. This is substantially more than the 4.2 kg/m$^2$ found for the combination of UD-SB2 and W557.

COMPARATIVE EXPERIMENT C

Vests of approx. 3.2 kg/m$^2$ were prepared in order to measure a standard ballistic performance of the various materials. Next, V50 was determined for 9 mm parabellum.

Results

| Material | Layers | AD (kg/m$^2$) | V50 (m/s) |
|---|---|---|---|
| δB2 | 20 | 3.1 | 439 |
| W557 | 12 | 3.2 | <295 |
| Twaron CT 930 dTex | 16 | 3.2 | 353 |
| Twaron VD0461 | 7 | 3.3 | <304 |

These results confirm the impression that a loose fabric alone gives a lower level of performance: the Dyneema W557 and Twaron VD0461 fabrics cannot even stop the 9 mm bullet at approx. 300 m/s. The results also indicate that SB2 scores better than an aramid fabric based on Twaron CT 930 dTex with a comparable areal density.

The invention claimed is:

1. Ballistic vest containing a stack of flexible fabrics and a stack of flexible unidirectional layers, in which the fabrics contain strong fibres of a first kind, the unidirectional layers contain strong fibres of a second kind, and in which the fibres in a unidirectional layer run essentially parallel and are disposed at an anale to fibres in an adjacent layer which is greater than 0 degrees and wherein the flexible fabric is a loose fabric and is located on a strike side of the vest, in which the loose fabric contains at least 3 floats.

2. Vest according to claim 1, in which the loose fabric is a twill weave.

3. Vest according to claim 1, in which the percentages by weight of the stack of loose fabrics and the stack of UD layers is between 15:85 and 30:70%.

4. Ballistic vest containing a stack of flexible fabrics and a stack of flexible unidirectional layers, in which the fabrics contain strong fibres of a first kind, the unidirectional layers contain strong fibres of a second kind, and in which the fibres in a unidirectional layer run essentially parallel and are disposed at an angle to fibres in an adjacent layer which is greater than 0 degrees and wherein the flexible fabric is a loose fabric and is located on a strike side of the vest, in which the first and second stacks together have an areal density of less than 6 kg/m$^2$ and in which the vest has such ballistic resistance as to stop an Action 3 bullet with a velocity of up to 437 m/s with a trauma to NIJ Standard of less than 44 mm.

5. Ballistic vest containing a stack of flexible fabrics and a stack of flexible unidirectional layers, in which the fabrics contain strong fibres of a first kind, the unidirectional layers contain strong fibres of a second kind, and in which the fibres in a unidirectional layer run essentially parallel and are disposed at an angle to fibres in an adjacent layer which is greater than 0 degrees and wherein the flexible fabric is a loose fabric and is located on a strike side of the vest, in which the first and second stack together have an areal density of less than 4.5 kg/m$^2$ and in which the vest has such ballistic resistance as to stop an Action 3 bullet with a velocity of up to 385 m/s with a trauma to NIJ Standard of less than 44 mm.

6. Vest according to claim 1, in which the first and second stack together have an areal density of less than 5.2 kg/m$^2$ and in which the vest has such ballistic resistance as to comply with NIJ3a Standard 0101.03.

7. Vest according to claim 1, in which the unidirectional layer contains mainly aramid or polybenzazole (PBO) fibres.

8. Vest according to claim 7, in which the first and second stack together have an areal density of less than 4 $kg/m^2$ and in which the vest has such ballistic resistance as to stop an Action 3 bullet with a velocity of up to 385 m/s with a trauma to NIJ Standard of less than 44 mm.

9. Vest according to claim 1, in which the fabric is a 5.1 twill weave fabric.

10. Vest according to claim 1, wherein the loose fabric contains ultrahigh molecular weight polyethylene fibers.

11. Vest according to claim 2, wherein the loose fabric contains ultrahigh molecular weight polyethylene fibers.

12. Vest according to claim 3, wherein the loose fabric contains ultrahigh molecular weight polyethylene fibers.

13. Vest according to claim 9, wherein the loose fabric contains ultrahigh molecular weight polyethylene fibers.

14. Vest according to claim 1, wherein the unidirectional layers contain ultrahigh molecular weight polyethylene fibers.

15. Vest according to claim 4, wherein the loose fabric contains at least 3 floats.

16. Vest according to claim 5, wherein the loose fabric contains at least 3 floats.

17. Vest according to claim 4, wherein the loose fabric is a twill fabric.

18. Vest according to claim 5, wherein the loose fabric is a twill fabric.

19. Vest according to claim 4, wherein the loose fabric contains ultrahigh molecular weight polyethylene fibers.

20. Vest according to claim 5, wherein the loose fabric contains ultrahigh molecular weight polyethylene fibers.

21. Vest according to claim 4, wherein the unidirectional layers contain ultrahigh molecular weight polyethylene fibers.

22. Vest according to claim 5, wherein the unidirectional layers contain ultrahigh molecular weight polyethylene fibers.

* * * * *

UNITED STATES PATENT AND TRADEMARK OFFICE

CERTIFICATE OF CORRECTION

PATENT NO. : 7,114,186 B2
APPLICATION NO. : 11/007330
DATED : October 3, 2006
INVENTOR(S) : Steeghs et al.

It is certified that error appears in the above-identified patent and that said Letters Patent is hereby corrected as shown below:

Face Page, right column, (57) ABSTRACT, line 1, replace “stock” with --stack--.

Column 1, line 32, insert a period --.-- after the word “art”;

Column 1, line 65, replace “ran” with --can--; and

Column 2, line 36, replace “I will” with --Twill--.

Signed and Sealed this

Sixth Day of March, 2007

JON W. DUDAS
*Director of the United States Patent and Trademark Office*